US005617586A

United States Patent [19]

PeQueen et al.

[11] Patent Number: 5,617,586

[45] Date of Patent: Apr. 8, 1997

[54] TATTOO HOSIERY HAVING TRANSLUCENT INK

[76] Inventors: Gloria I. PeQueen; Earl J. PeQueen, both of 319 Browns Valley Rd., Watsonville, Calif. 95076

[21] Appl. No.: 673,013

[22] Filed: Jul. 1, 1996

Related U.S. Application Data

[63] Continuation of Ser. No. 489,537, Jun. 12, 1995, abandoned, which is a continuation of Ser. No. 308,406, Sep. 14, 1995, Pat. No. 5,450,790.

[51] Int. Cl.[6] ..... A41B 11/00

[52] U.S. Cl. ..... 2/239

[58] Field of Search ..... 2/239, 409, 242, 2/113, 69; 66/177, 178, 180; 101/35, 114, 126, 129, 474, 481, 483, 485; 8/486, 588, 591, 598

[56] References Cited

U.S. PATENT DOCUMENTS

| | | | |
|---|---|---|---|
| 1,743,998 | 1/1930 | Dinkelspiel | 2/69 |
| 4,282,609 | 8/1981 | Freedman et al. | 2/239 |
| 4,546,493 | 10/1985 | Bortnick | 2/67 |
| 4,635,551 | 1/1987 | Croxall | 8/471 |
| 4,728,538 | 3/1988 | Kaspar et al. | 427/288 |
| 5,065,458 | 11/1991 | Johnson | 2/69 |
| 5,450,790 | 9/1995 | PeQueen et al. | 101/129 |

*Primary Examiner*—C. D. Crowder
*Assistant Examiner*—Larry D. Worrell, Jr.
*Attorney, Agent, or Firm*—Robert Samuel Smith

[57] ABSTRACT

A hose having a multicolored decoration and method for making in which the decoration appears to be a tattoo on the skin of the wearer under the hose. The illusion is created by screen printing water based acrylic inks onto the hose wherein the properties of the ink, particularly the viscosity and surface tension, is selected in operable combination with the selected denier and modification number of the fiber of the fabric to maximize the reflectivity and transmissivity of the decorated fabric. Each color is screen printed in succession with the other colors. Registration between areas of the design is maintained by steps of the method including the step of preshrinking the hose and by using a novel rack to load the hose onto a form having an adhesive coating.

3 Claims, 3 Drawing Sheets

TATTOO HOSIERY HAVING TRANSLUCENT INK

This is a continuation of application Ser. No. 08/489,537, filed on Jun. 12, 1995, now abandoned which was a continuation of 308,406 filed Sep. 14, 1995, now issued as U.S. Pat. No. 5,450,790.

FIELD OF THE INVENTION

This invention relates to the field of printing on hosiery and particularly to hose having a decoration thereon which appears to be a genuine tattoo imbedded in the legs of the wearer.

PRIOR ART AND INFORMATION DISCLOSURE STATEMENT

Mankind has had a long world wide history of decorating various parts of the body with tattoos. However, many people who are interested in getting a tattoo are dissuaded by several considerations.

One consideration is that a tattoo is essentially permanent but the prospective wearer may not want to wear the tattoo all of the time. Furthermore, the wearer may want to change the design of the tattoo.

Another consideration is that tattoos are expensive, costing hundreds or thousands of dollars. Developing a decorative tattoo can require an appreciable amount of time of a skilled artist.

Yet another consideration is that getting a tattoo is painful, involving having one's skin punctured thousands of times to imbed the ink in the skin and expose the wearer to the risk of infection.

All of these problems are powerful arguments against the step of acquiring a tattoo so that other means are considered for achieving the effect of an attractive tattoo.

Temporary tattoo paint is available to those with the time and access to the skill to paint on a design which will last only two or three days before it must be removed or repainted.

Temporary tattoo decals are also available but do not provide the satisfaction of a genuine tattoo in terms of permanence.

Decorative hose has made its appearance as an alternative method of decorating the legs. However, ladies' hose is very difficult to print onto because of the diaphanous quality of the fabric. Diaphanous quality makes it difficult to maintain registration between the various colored areas of the design. Diaphanous in the context of this specification is understood to mean fabric woven from fiber that is between 13 to 25 denier. Ladies fine hosiery is woven from nylon fiber that has a denier in the range from fifteen to twenty denier.

Because of this difficulty, the use of hot press printing onto hosiery has been adapted by the present state of the art as a means of maintaining dimensional stability of the diaphanous fabric during the printing process. The hot press printing process is performed by first placing sheets of a print carrier (such as printing paper) on a form, followed by a hot pressing operation to transfer the print from the carrier to the hosiery. However, hot press printing involves the use of plastisol paints which coat the fabric rather than penetrate the fabric and thereby diminish the sheen of the fabric to an extent such that the painted fabric gives no illusion that the product is anything different than painted fabric. Specifically, hot press printing precludes the use of that class of printing inks which would penetrate the fibers of the fabric, would not modify the topographical characteristics of the fiber fabric, and thereby would preserve the sheen of the bare fabric. These are principally water soluble inks that are acrylic based which are thermosetting rather than thermoplastic in contrast to the plastisols.

The inks presently used in the decoration of hose using state of the art printing techniques dramatically change the sheen of the fabric thereby giving the fabric its "painted" appearance. The sheen of nylon fabric is directly related to the cross sectional shape of the fabric which determines the number of reflecting surfaces on the fiber. This factor is described quantitatively in terms of a "MODIFICATION NUMBER" which equal the ratio of the diameter of an outer circle divided by the diameter of an inner circle. The outer circle is the smallest circle that can be drawn around the outside of the fiber without penetrating the fiber and the inner circle is the largest circle that can be drawn entirely inside the fiber. Accordingly, the MODIFICATION number of a round fiber is "one" and makes the least reflecting fabric. The fabric of ladies hose has a MODIFICATION NUMBER that is typically in the range from 1.4 to 1.7 and has a high sheen. Fiber that has a modification number greater than about 1.7 has less sheen because many points of reflected light are developed that gives the visual effect of dullness.

As noted above, the printing practices of the present state of the art result in a complete loss of sheen because the multifaceted surface of the fibers has been dramatically modified.

Hot press printing as carried out on hose has been disclosed.

For example, U.S. Pat. No. 4,635,551 to Croxall discloses a hot processing operation with a modified form that eliminates discontinuities in important areas of the hose.

U.S. Pat. No. 4,728,538 to Kaspar et al discloses an apparatus and method for continuously applying a dot pattern of a non-slip composition to a plurality of garments. The apparatus includes a transfer cylindrical screen roller having a plurality of holes arranged in the desired pattern to be printed and means for forcing the composition through the holes of the transfer roller onto the hose. The deposited array of dots is intended to confer a nonslip property to specific areas of the hose such as the soles of the feet.

U.S. Pat. No. 4,282,609 to Freedman et al discloses hose that has shades of color intended to enhance shape of the legs printed directly on the hose by heat transfer paper printing.

U.S. Pat. No. 1,743,998 to Dinkelspiel discloses a method for manufacturing hosiery having legs fabricated from machine-made embroidery expansible in all directions. The design is part of the hosiery and is fixed in place at the time that the hosiery is manufactured and does not appear to be on the skin of the wearer and does not resemble a tattoo.

U.S. Pat. No. 5,065,458 to Johnson discloses a garment having areas of shaded color intended to present an illusion of a more attractive body shape.

None of the foregoing disclosures of hot press printing techniques address the problem of maintaining the close registration that is required for screen printing.

Screen printing has been adapted for printing on T shirts in which the T-shirt is slipped over a form coated with an adhesive that prevents the garment from slipping during the hot press operation and permits peeling the T shirt from the form after the printing has been performed. However, the conventional practices adapted to screen printing T shirts are not adaptable to hose because of the lighter more diaphanous quality of the hose. A major problem is fitting the hose over a form that has a sticky surface without distorting the garment in view of the diaphanous nature of the fabric Another reason why screen printing on hose has not been developed by industry is because failure to recognize the advantages of screen printing as practiced in accordance with this invention has resulted in no effort to develop a screen printing process for sheer fabrics having a high sheen such as hosiery.

The methods disclosed in the foregoing citations do not cream any illusion that the wearer's legs are tattooed. The products of these methods on the legs of the wearer simply appear to be what they are: decorated stockings.

The foregoing considerations suggest that a substantial market would exist for a product that provides the features of the tattoo, appealing decoration of the legs, without the attendant disadvantages listed above.

THE INVENTION

OBJECTS:

It is an object of this invention to provide a sheer hose with an imprinted design wherein the characteristics of the imprinted design give an impression to a viewer that the wearer has a permanent tattoo on her legs under the hose.

It is contemplated that the wearer may thus provide herself with a plurality of designs from which she may select a design according to her whim or current style of dress. It is also an object of this invention that the wearer need not rely on the services of a skilled tattoo artist to decorate her legs and need only take the time required to decide on the design of her choice.

It is another object of this invention that the colors used in decorating the hose of this invention closely approximate the colors used in conventional tattooing, and include, but are not limited to blue, green, red, yellow and black.

It is another object that the design in the hose be nontoxic in contact with the skin, permanent, colorfast, blendable, nonstiffening, machine washable, drycleanable, and nonfading such that the garment is washable and reusable using means appropriate for cleaning delicate hosiery.

It is a further object that the designs stretch in all directions without cracking or peeling.

It is another object to provide a method adaptable to screen printing on large quantities of fabric woven using fiber having a denier in the range from thirteen to twenty five denier.

SUMMARY

This invention is directed toward a sheer decorated garment, particularly hosiery, and method for decorating sheer hosiery in which the decoration appears to be an authentic tattoo on the skin of the wearer under the garment. The illusion is created in part by printing a design on the hosiery using a printing ink that has a translucent quality and does not diminish the sheen of the fabric Because the imprinted ink is translucent and the fabric has a sheen that is not altered by the printing process, the appearance of the topographic features of the fabric is not obscured such as is the case with the use of opaque inks so that the design appears to be a tattoo directly on the skin showing through the fabric.

An essential step in performing the novel process by which the design is formed is to preshrink the garment by the application of heat before the design is applied. Then the hose is mounted onto a form and each color of the multicolored design is screen printed onto appropriate areas of the hose. The hose is heated after each application. The initial preheating step prevents subsequent loss of registration between parts of the design as the various colors are applied.

In order to screen print successive colors in various areas of the hose and maintain registration between areas after preshrinking, the hose is mounted onto a novel rack which holds the interior of the rack open in order that a form coated with adhesive may be inserted into the interior region of the hose without touching the inside surfaces of the hose. Then the rack is withdrawn allowing the hose to collapse onto the form to which it is temporarily adhered for the multistep screen printing process.

THE DRAWINGS

DESCRIPTION OF A PREFERRED EMBODIMENT

Figure 1:
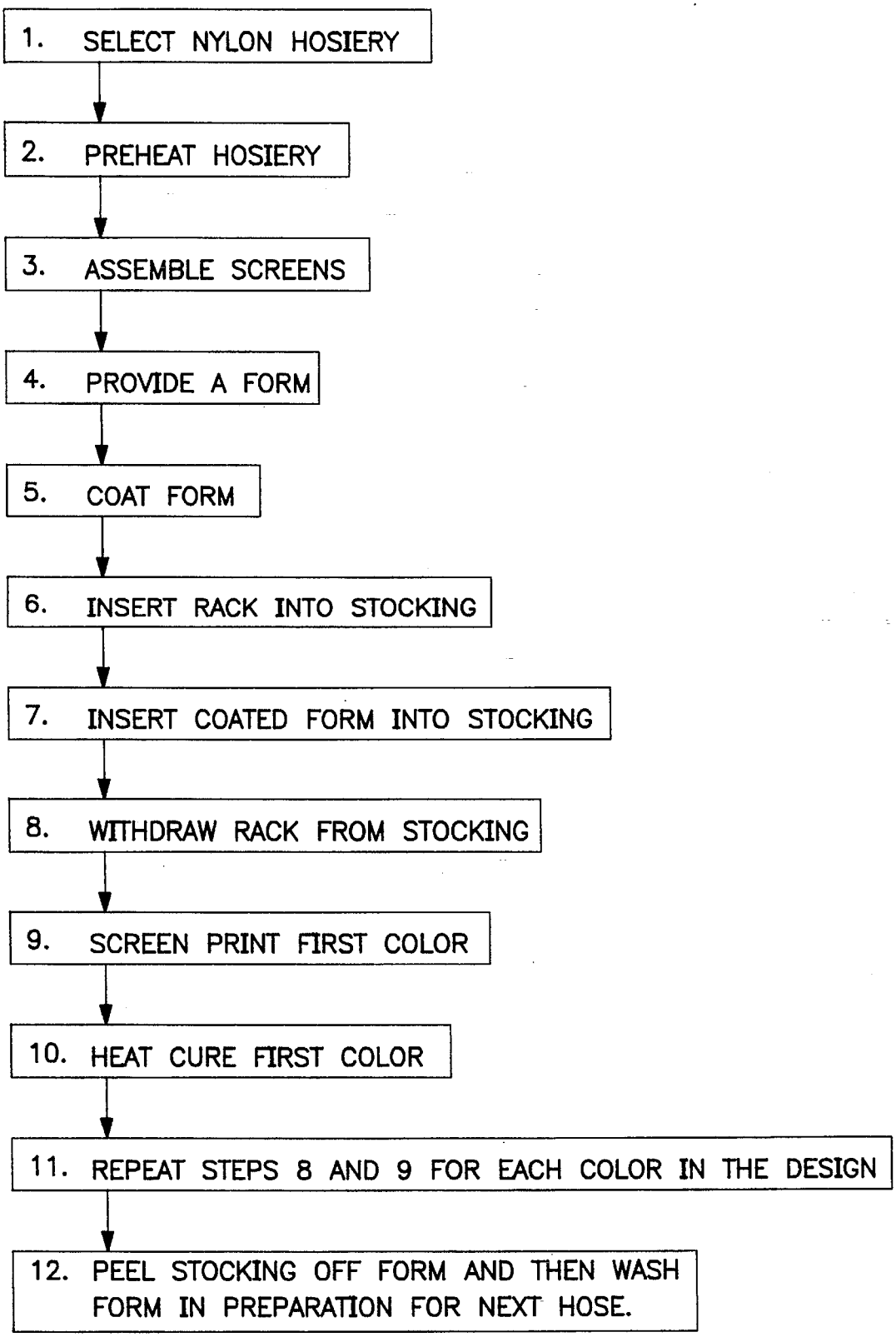
FIG. 1 is a flow chart of the screen printing process.

Turning now to a discussion of the drawings, FIG. 1 shows the steps taken to produce the decorated hose of this invention.

Step 1. Select nylon hosiery for decorating wherein the fiber has a denier in the range of 13 to 25 and a modification number in the range 1.4 to 1.7. Nylon fabric woven from such fabric together with subsequent coating with a translucent paint gives a combination of sheerness and sheen such that the decorated fabric in contact with the skin gives the appearance of a decoration (tattoo) that is on the skin rather than simply being decorated cloth.

Step 2. Heat the hosiery to be screen printed to a temperature of 300°–350° F. for period of 60 to 90 seconds thereby preshrinking the hose. This step is required because, as each color of the design is screen printed onto the hosiery, the hosiery is heated in order to cure the printing ink The hosiery must be preshrunk before curing the printed ink in order to maintain registration between the various colored areas of the design.

Figure 2:
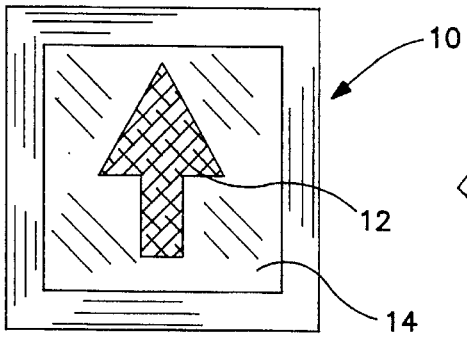
FIG. 2 shows a screen for the printing process.

Step 3. Assemble a quantity of screens for screen printing, each screen having a pattern of openings in its surface corresponding to an area having one of a plurality of colors in the design to be screen printed. One screen 10 is shown in FIG. 2 having a pattern of open screen area 12 outlined by a solid area 14.

Figure 3:
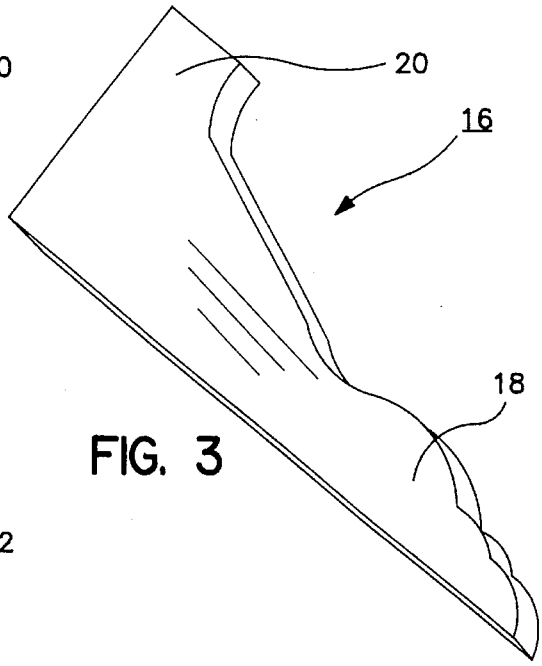
FIG. 3 shows a form for supporting the hose for the printing process.

Step 4. Provide a form which is a flat panel having the shape of an outline of a leg and a size determined by the size of the stocking such that, when the form is inserted into the stocking, no wrinkles are formed in the stocking. A form 16 is shown in FIG. 3 having a foot section 18 and a handle end 20. The form is preferably cut from a lightweight panel such as 16 ga. aluminum or one eighth inch tempered hardboard that is thoroughly cured to withstand the temperature of the curing step of the ink.

Step 5. Coat the form with an adhesive having sufficient tack to secure the stocking against the form when the form is inserted into the stocking but such that the form can be readily peeled from the stocking after the screen printing operations have been completed. The adhesive coating prevents inadvertent stretching or shrinking of the fabric during the steps of the screen printing process thereby maintaining registration between the areas of the design. A temporary adhesive glue such as "SPRAY WAY 66 from Spray Way Inc. of Addison, Ill., is suitable for this purpose.

Figure 4:
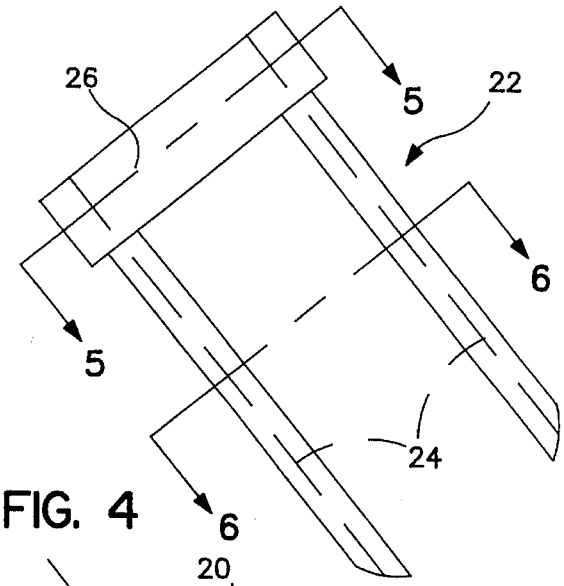
FIG. 4 shows a rack for loading hose onto the form of FIG. 3.
Figure 5:
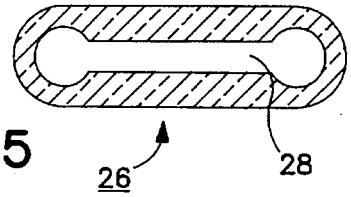
FIG. 5 is a sectional view of the joining member (handle) of the rack of FIG. 4.
Figure 6:
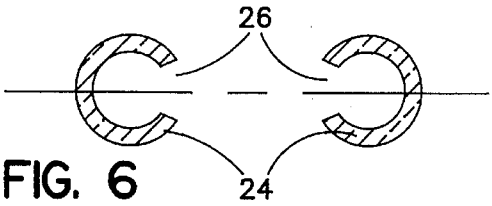
FIG. 6 is a sectional view showing slots in the legs of the rack of FIG. 4.

Step 6. Insert legs of a rack into the hose. The rack holds the hose open in order to permit inserting the form coated with adhesive into the stocking and positioning the stocking around the form without actually coming in contact with the adhesive surface. FIG. 4 shows a rack 22 having two parallel legs 24 and a joining bat 26. FIG. 6 is a sectional view of the legs 24 showing a slot 26 in each leg 24. FIG. 5 is a sectional view of the joining bar showing an elongated slot 28.

Figure 7:
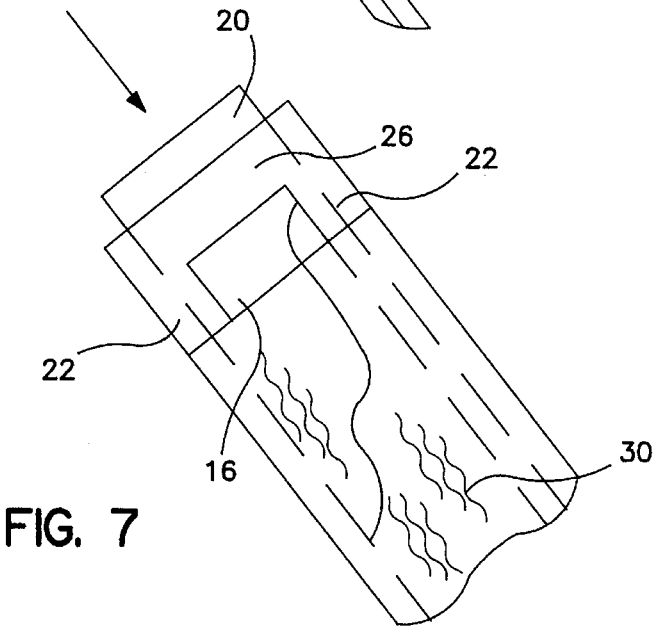
FIG. 7 illustrates loading the hose onto the form using the rack.

Step 7. Slide the form 16 through the slot 28 in joining bar 26 and into the hose 30 as shown in FIG. 7. Slots 26 engage edges of form 16. The form is inside of but out of contact with the hose and between the legs 24 of the rack 22.

Figure 8:
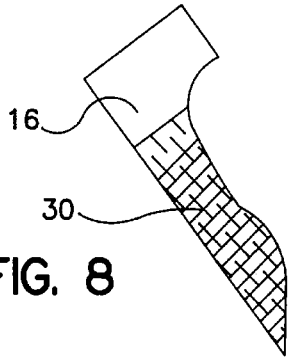
FIG. 8 shows the hose loaded onto the forth and ready for screen printing.

Step 8. Withdraw the rack 22 from the hose 30 so that the hose 30 collapses onto the form 22 and adheres to the adhesive surface of the form 22 as shown in FIG. 8 providing that successive screening steps can proceed without loss of registration between screenings.

Step 9. Screen print the first color of the design onto the hose. The ink used in this process is a water based acrylic ink that is translucent when dried. The translucent quality of the ink provides that the sheen of the fabric will be preserved after the screen printing process. Acrylic water based inks for screen printing having the required character of translucency can be formulated by and obtained from Decart Inc., located in Morrisvile, Vt. and sold as DEKA PRINT.

Step 10. Heat cure the first screen printed color.

11. Repeat steps 8 and 9 for each color.

12. Peel hose from form and then wash the form in preparation for the next hose.

A wide range of colors is available from the manufacturer for incorporation into the designed hose of these invention These colors include (but are not limited to) blue, green, red, yellow and black.

The water based acrylic inks preferred for the practice of this invention are nontoxic, permanent, colorfast, blendable, nonstiffening, machine washable, nonfading so that the hose is reusable. Procedures used to wash delicate hosiery are recommended for cleaning the decorated hosiery of this invention.

Variations of the method of this invention can be anticipated after reading the specification which are within the scope of the invention.

For example, the ink may be cured at room temperature using a curing catalyst.

A step of using a viscosimeter may be adapted for measuring and controlling the viscosity and a stalagmometer for measuring and controlling surface tension of the printing ink and thereby maintain the viscosity and surface tension of the ink to achieve a required sheer and sheen of the decorated hose so as to enhance the illusion that the decorated hose is a tattoo on the legs of the wearer under the hose. Optimum values of viscosity and/or surface tension depends on the composition of the ink and the denier and modification number of the fabric.

Figure 9:
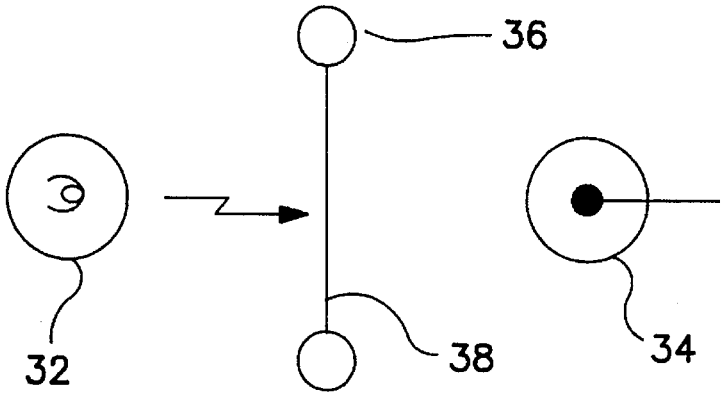
FIG. 9 shows an apparatus for measuring sheer.

FIG. 9 shows an apparatus for measuring sheer expressed as transmissivity of the decorated fabric and includes a light source 32, a photodetector 34 and a frame 36 supporting hose (fabric) 38 between light source 32 and photodetector 34. Sheer is expressed as transmissivity of light through the fabric indicated by the signal generated in photodetector 34.

Figure 10:
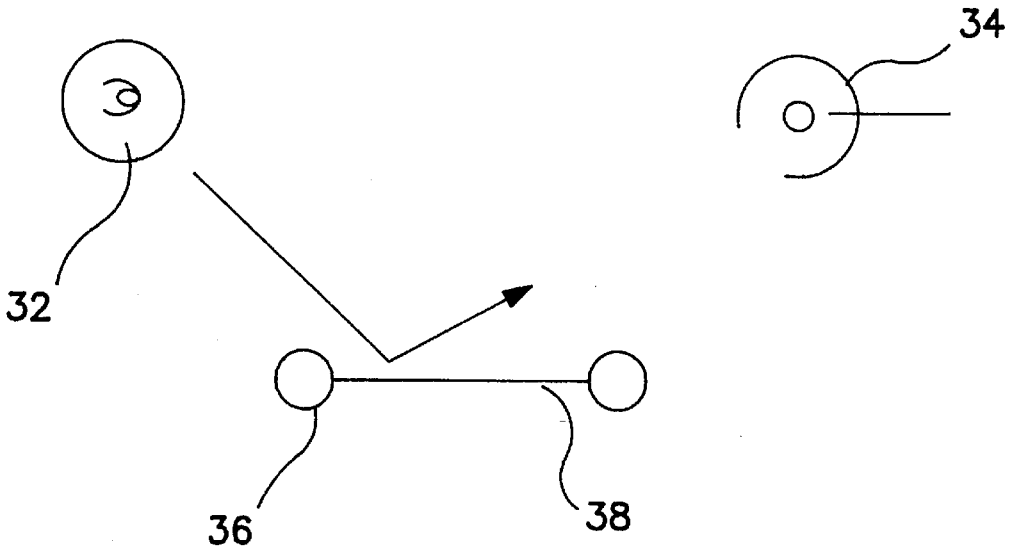
FIG. 10 shows an apparatus for measuring sheen.

FIG. 10 shows an apparatus for measuring sheen expressed as reflectivity of the fabric and includes a light source 32, a photodetector 34, and a frame 36 supporting hose (fabric) 38. Intensity of light from light source 32 and reflected by the surface of the fabric 38 generates a signal from the detector 34. Sheen is expressed as reflectivity of light from the fabric indicated by the signal generated in photodetector 34.

In view of these and other variations and modifications of the process which are within the scope of this invention, we wish to define our invention by the appended claims.

We claim:

1. A decorated hose wherein a wearer of said hose has an appearance of a tattoo under said hose which comprises:

said fabric being woven from a fiber having a value of denier in the range of values from 13 to 25;

said fiber having a value of modification number lying in a range of values between 1.4 and 1.7;

said hose having a plurality of areas, each area registered with adjacent areas and having a color in accordance with a design on said hose;

each area being printed with a water based acrylic ink having a translucency;

said translucency having a value selected in operable combination with said value of denier and modification number such as to optimize said appearance of a tattoo on a leg of a wearer under said hose.

2. A decorated hose as in claim 1 wherein said fabric is nylon.

3. A decorated hose comprising:

a fabric woven with nylon fiber having a sheer characteristic expressed as denier of said fiber and a sheen characteristic expressed as a modification number of said fiber;

said denier having a value selected from a range of values between 13 and 25;

said modification number selected from a range of values between 1.4 and 1.7;

a decoration of ink deposited on said fabric wherein said ink is a water based acrylic ink that is translucent when dried on said fabric whereby said decoration presents an appearance of being a tattoo on a skin of a user when covering said skin.

* * * * *